US007866246B2

(12) United States Patent
Bellino et al.

(10) Patent No.: US 7,866,246 B2
(45) **Date of Patent: *Jan. 11, 2011**

(54) METHOD FOR RAPID COUNTERMEASURE DEPLOYMENT USING A POD

(75) Inventors: Frank Joseph Bellino, Inyokern, CA (US); John Andrew Johnson, Ridgecrest, CA (US); David Virgil Jester, Ridgecrest, CA (US); Roy Joseph Harmon, Ridgecrest, CA (US); Timothy Allen Froehner, Ridgecrest, CA (US); Alberto Garza, Ridgecrest, CA (US); Richard Matthew Dillon, Camarillo, CA (US); Hugh Henley Hood, Crestview, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 305 days.

This patent is subject to a terminal disclaimer.

(21) Appl. No.: 11/863,797

(22) Filed: Sep. 28, 2007

(65) Prior Publication Data

US 2009/0084254 A1 Apr. 2, 2009

(51) Int. Cl.
*F41F 5/00* (2006.01)

(52) U.S. Cl. ..... 89/1.51; 102/340; 342/12

(58) Field of Classification Search ..... 89/1.51
See application file for complete search history.

(56) References Cited

U.S. PATENT DOCUMENTS

| | | | | |
|---|---|---|---|---|
| 3,430,533 | A * | 3/1969 | Kifor et al. | 89/1.51 |
| 4,621,579 | A * | 11/1986 | Badura et al. | 102/334 |
| 5,136,951 | A * | 8/1992 | Herrlinger | 102/340 |
| 5,198,609 | A * | 3/1993 | Gillman | 89/1.51 |
| 6,619,178 | B1 * | 9/2003 | Fransson et al. | 89/1.51 |
| 7,509,910 | B1 * | 3/2009 | Nofsinger et al. | 102/361 |
| 7,614,334 | B2 * | 11/2009 | Bellino et al. | 89/1.51 |
| 2009/0084253 | A1 * | 4/2009 | Bellino et al. | 89/1.51 |

* cited by examiner

*Primary Examiner*—Bret Hayes
*Assistant Examiner*—Reginald Tillman, Jr.
(74) *Attorney, Agent, or Firm*—Robert L. Lerma; Christopher L. Blackburn

(57) ABSTRACT

The invention generally relates to a method of using a pod to rapidly deploy defensive countermeasures from a wide variety of manned aircraft. The method includes using a configurable pod for dispensing different types of infrared countermeasure (IRCM) devices and different types of radio frequency countermeasure (RFCM) devices at a rapid rate. The primary purpose of this method is to rapidly dispense IRCMs and RFCMs is to protect the host aircraft while ingress and egress maneuvers are performed in a hostile area. A secondary use of the method is for use in defending commercial aircraft from missile threats.

8 Claims, 4 Drawing Sheets

METHOD FOR RAPID COUNTERMEASURE DEPLOYMENT USING A POD

BACKGROUND OF THE INVENTION

1. Field of the Invention

The invention generally relates to a method of using a pod to rapidly deploy defensive countermeasures from a wide variety of manned aircraft. The method includes using a configurable pod for dispensing different types of infrared countermeasure (IRCM) devices and different types of radio frequency countermeasure (RFCM) devices at a rapid rate. The primary purpose of this method is to rapidly dispense IRCMs and RFCMs is to protect the host aircraft while ingress and egress maneuvers are performed in a hostile area. A secondary use of the method is for use in defending commercial aircraft from missile threats.

2. Description of the Prior Art

It is well known that a variety of countermeasures are available to provide a defense against a variety of missile types. It is necessary for an aircraft to be configured to deploy a countermeasure that is specific to the missile threat expected to be encountered. Modern missile seeker heads are sensitive to infrared information generated by aircraft engines, fuselage leading edge surfaces or to reflected radar signals. Handheld surface to air missiles designed to attack low flying aircraft are referred to as Manpads and are prolific, effective and come in a number of variants. During the conflict between Russia and Afghanistan it is estimated that the Russian forces lost more than three hundred helicopters and more than one hundred and ten fixed wing aircraft to Manpad systems.

Domestic and foreign military forces using aircraft in low level combat operations have devised a number of systems to deploy both IRCM and RFCM devices. A typical countermeasure system will first use a missile launch detector to alert the aircrew that the aircraft is under attack. The countermeasure system or aircrew will then determine the type of missile that is to be defended against, IR or RF. The aircrew will then have the option of making evasive maneuvers or deploying an appropriate countermeasure.

The survivability rate for this type of attack is highly weighted towards the effective use of countermeasures when compared to the use of evasive maneuvers. Evasive maneuvers are not possible when a troop transport and their escorting aircraft need to ingress to drop troops or cargo and then safely egress. A typical mission scenario produces ten minutes of vulnerability broken down as an ingress lasting four minutes followed by two minutes on the ground to complete the deployment portion of the mission and then four minutes to safely egress. Defensive coverage against manpads is provided by a flare launched every three seconds. The typical mission scenario requires dispensing twenty flares per minute for ten minutes which requires two hundred flares. Mission scenarios are dependent upon the theater of operation and the intelligence information particular to that theater of operation. The threat parameters, the cargo to be delivered and the aircraft type selected for a particular mission scenario will drive the type and quantity of flares to be dispensed.

The United States military has developed and deployed a number of countermeasure systems and has used pods as housings. The pods that have been used to house the countermeasure systems are customized for each dispensing system and then customized to each aircraft type. This has lead to an inventory of pods that are not adaptable to new dispensing systems and are not adaptable to multiple service aircraft. This invention will lead to a reduction in the variety of pods needed to be maintained in the military logistics system because of the commonality in the mechanical and electrical interfaces.

Current countermeasure pod systems are not capable of deploying countermeasure devices at the rate or the quantity necessary to effectively defend against multiple manpad attacks. Currently, there is not a reusable lightweight package that is suitable for mounting on a number of aircraft types which contains all of the components necessary to rapidly deploy IRCM and RFCM devices. A low cost countermeasure dispensing system interfaced to an aircraft's digital countermeasure suite that is easily modified is not currently available. Given the current manpad threat to civilian aviation this invention is suitable for installation on both commercial and private aircraft.

SUMMARY OF THE INVENTION

The preferred embodiment is a reusable compact lightweight pod containing a digital interface to communicate with an aircraft detection system, countermeasure dispenser sequencers, a number of countermeasure dispensers and is configured to be mounted on a number of aircraft without modifying the pod or the aircraft.

The pod container which houses the countermeasure dispensing components is externally configured with a number of aircraft mounting lugs. The availability of multiple types of mounting lugs allows the pod to be mounted to a wide variety of aircraft without modifications. The pod container is aerodynamic having a missile shaped body fitted with a nose cone and a tail section. The pod is built with internal structural components and compartments that support internal mounting of the countermeasure dispensing components.

The preferred embodiment uses an ALE-47 countermeasures dispensing system. All of the dispensing components necessary to deploy the IRCM and RFCM devices are carried within the pod. The dispensing components are a power supply, a microcomputer, a number of sequencers and the dispenser units. The dispensing units are prohibited from premature activation by a number of safety interlocks within the pod that overrides normal control of the pod's microcomputer.

The common services pod is unique in that the pod is readily adaptable to accepting new countermeasure dispensing systems by virtue of having reconfigurable internal compartments. The common services pod is also unique in that the pod is readily adaptable to being mounted onto a new type of aircraft simply by incorporating a new mounting lug.

DETAILED DESCRIPTION OF THE PREFERRED EMBODIMENT

The common services pod is built to carry and operate a number of dispenser units electrically connected to the host aircraft. The common services pod is missile shaped and mounted to a host aircraft with mounting lugs that allow the dispenser units to have a clear field of operation for dispensing the countermeasure devices when commanded.

Figure 2:
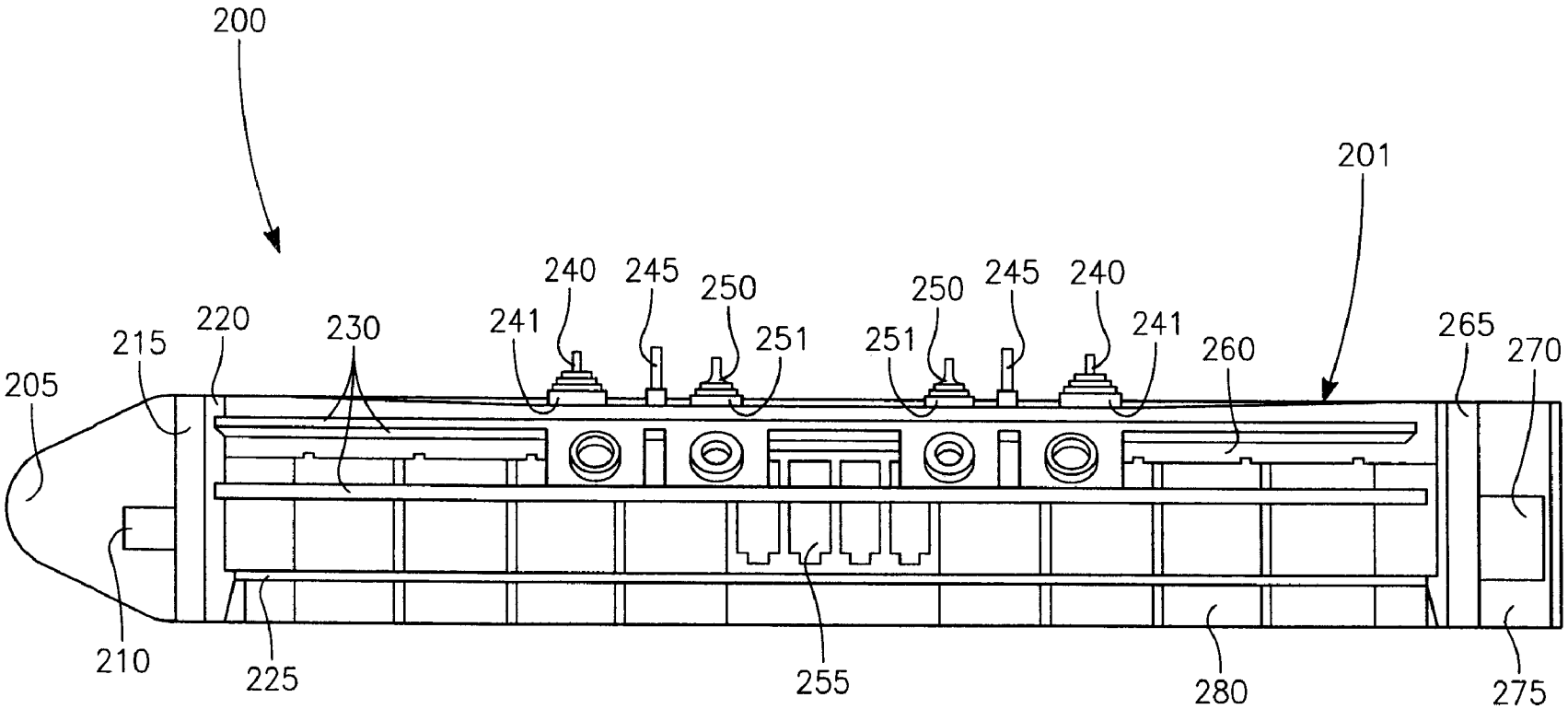
FIG. 2 is a diagram of the common services pod external features and internal features.
Figure 4:
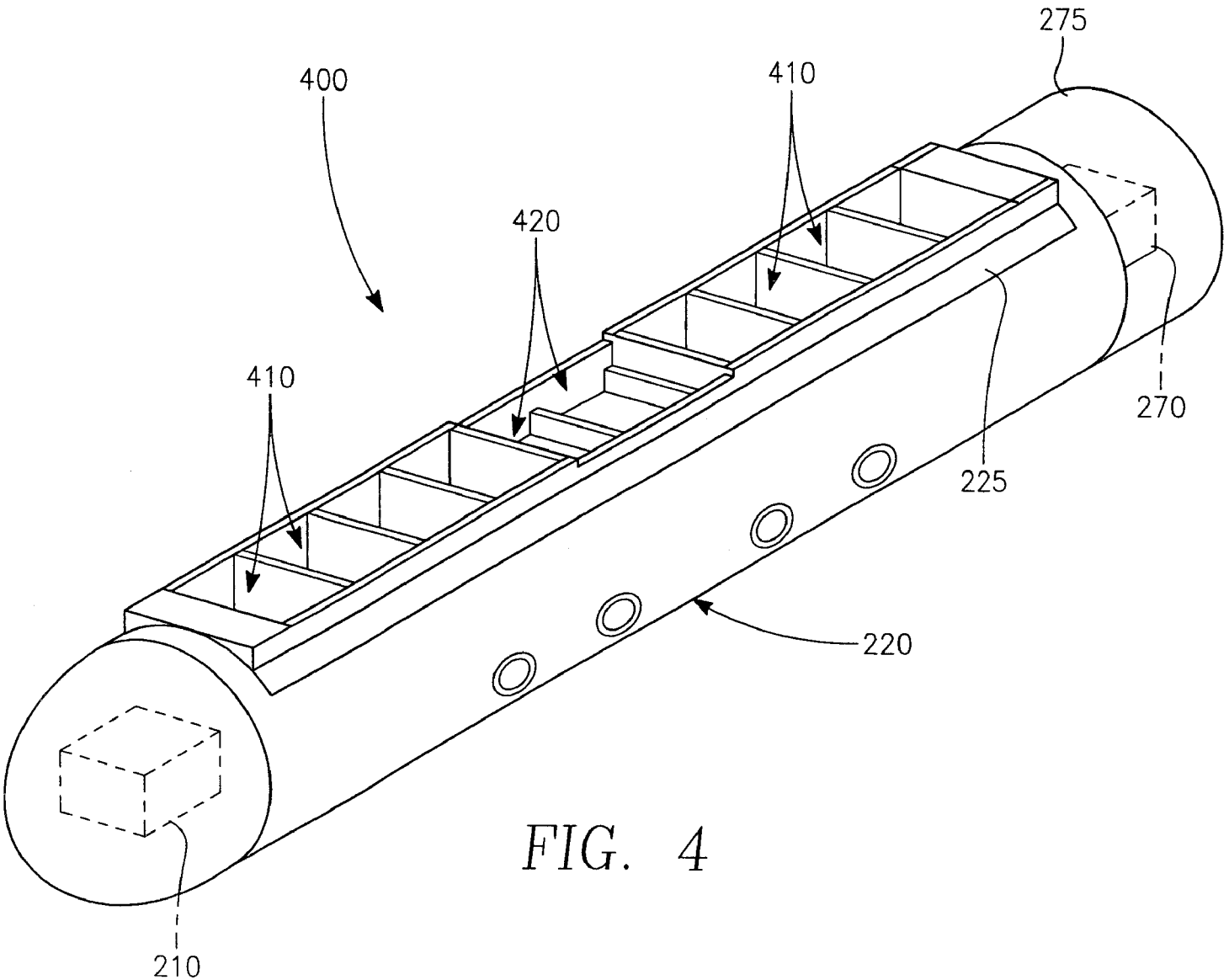
FIG. 4 is a three dimensional view of the common services pod showing the dispenser unit compartments.

Referring to FIGS. 2 and 4, the preferred embodiment is a pod container 201 which has an overall diameter not to exceed fourteen inches and a length not to exceed one hundred inches. The external skin of the main body tube 220 is made of 6061-T6 aluminum that is approximately 0.09 inches in thickness. Any 6000 series aluminum would suffice. The pod container 201 is aerodynamic having a missile shaped main body tube 220 fitted with a nose cone 210 and a tail section 275. The main body tube 220 contains sequencer compartments (FIG. 4 item 420) in a quantity sufficient to house four sequencer assemblies (FIG. 2 item 255) and dispenser compartments (FIG. 4 item 410) in a quantity sufficient to house eight dispenser assemblies (FIG. 2 item 280). To maintain a center of gravity that is as close to the center of the pod container 201 as possible the sequencer compartments (FIG. 4 item 420) are centered by placing four dispenser compartments (FIG. 4 item 410) on each side. To provide structural integrity for the pod several structural members run the along the length of the main body tube 220.

Referring to FIG. 2, the pod is built with several internal structural members that run along the length of the main body tube 220 for the purpose of providing strength to support the pod when mounted to the host aircraft and to provide a stable platform for dispensing the countermeasure devices.

The primary structural member is the strongback 260 to which the mounting lugs (items 240, 245 and 250) are mounted. The strongback 260 and mounting lugs (items 240, 245 and 250) in combination attach the pod to the host aircraft. One end of the strongback 260 is connected to a forward bulkhead 215 and the opposite end of the strongback 260 is connected to a rear bulkhead 265. The mounting lugs and lug adapters chosen for use in the preferred embodiment to support Navy aircraft are the NAVAIR 1380540 lugs 240 and the corresponding lug adapter 241. The mounting lugs and lug adapters chosen for use in the preferred embodiment to support Air Force aircraft are the MS3314 lugs 250 and the corresponding lug adapter 251. Use of these two lug types will allow the common services pod 201 to be used on multiple across services aircraft.

Also mounted to the strongback 260 is a set of bomb rack sway braces 245. The bomb rack sway braces 245 are used to provide aerodynamic stability between the host aircraft and the pod 201 during periods of high speed or high g maneuvers. The bomb rack sway bracing used in the preferred embodiment are of the type MAU-12×/A.

There are at least seven body longerons 230 which run the length of the main body tube 220. One end of each of the body longerons 230 is connected to the forward bulkhead 215 and the opposite end of each of the longerons 230 is connected to the rear bulkhead 265. The longerons 230 serve as stiffeners for the main body tube 220 while two of the lower longerons 230 serve as a structure to which a housing mounting rack 225 is attached. The dispenser assemblies 280 are mounted between the housing mounting rack 225.

It is well known in the arts that a flat aluminum sheet can be bent in the shape of a "U" to create a channel that will increase the overall stiffness of the aluminum sheet making it resistant to bending. This technique is used in producing the stiffening longerons 230 from aluminum sheeting.

In preferred embodiment, the countermeasure dispenser compartment (FIG. 4 item 420) has a volume sufficient to mount an ALE-47 countermeasure dispenser assembly also known as a bucket (FIG. 2 item 280). Each dispenser compartment 420 holds one or more buckets depending upon the flare type. The buckets are standard containers that hold the flares or chaff and have fixed external dimensions. Since the flares and chaff vary in size the internal configuration of the bucket changes with the load. A bucket for MJU-10 flares would hold six flares. Forty eight MJU-10 flares would be a full pod load. Eight buckets each holding six flares equates to forty eight MJU-10 flares per pod. A bucket for M206 flares would hold thirty flares. Two hundred forty flares would be a full pod load. Eight buckets each holding thirty flares equates to two hundred forty flares.

Referring to FIG. 2, the preferred embodiment uses an Air Force ALE-47 countermeasures dispensing system. All of the components that comprise the ALE-47 countermeasures dispensing system are carried within the pod. The dispensing components carried within the pod are a power supply 210 mounted to the forward bulkhead 215, a HiDAN PC-104 microcomputer 270 mounted to the rear bulkhead 265, four sequencers 255 and the eight dispenser assemblies 280. The common services pod is not constrained to the use of the ALE-47 system.

Other embodiments of the invention include the use of an ALE-29 countermeasure dispensing system and the Navy version of the ALE-47 dispensing system. The ability of the common services pod to adapt to any suitable dispensing unit system provides the flexibility to configure an aircraft to deploy defensive countermeasures, this is the essence of this invention. The adaptability is provided by the compartments and mounting surfaces that define the common services pod.

Figure 1:
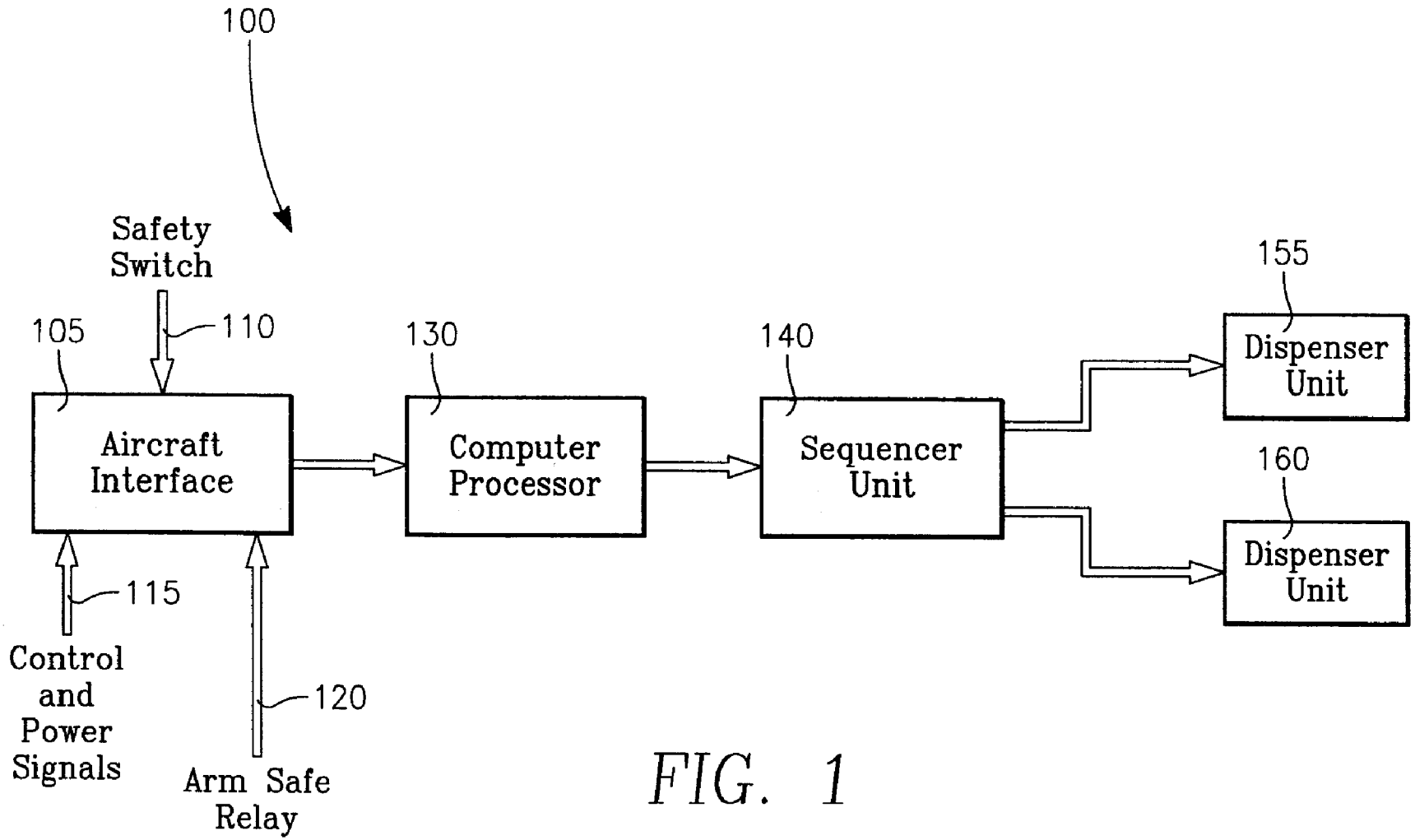
FIG. 1 is a block diagram of the preferred embodiment's countermeasure system.

FIG. 1 is a functional block diagram showing the major components of a generic countermeasures dispensing system 100. The common services pod host aircraft interface 105, accepts from the host aircraft power and control signals 115, accepts input from a safety switch 110 and accepts input from an arm and safety relay 120. The aircraft interface 105 is connected to a computer processor 130 that is part of the countermeasure dispensing system 100 which controls the sequencer unit 140. The sequencer unit 140 in turn sends control signals to multiple dispenser units (155 and 160).

Figure 3:
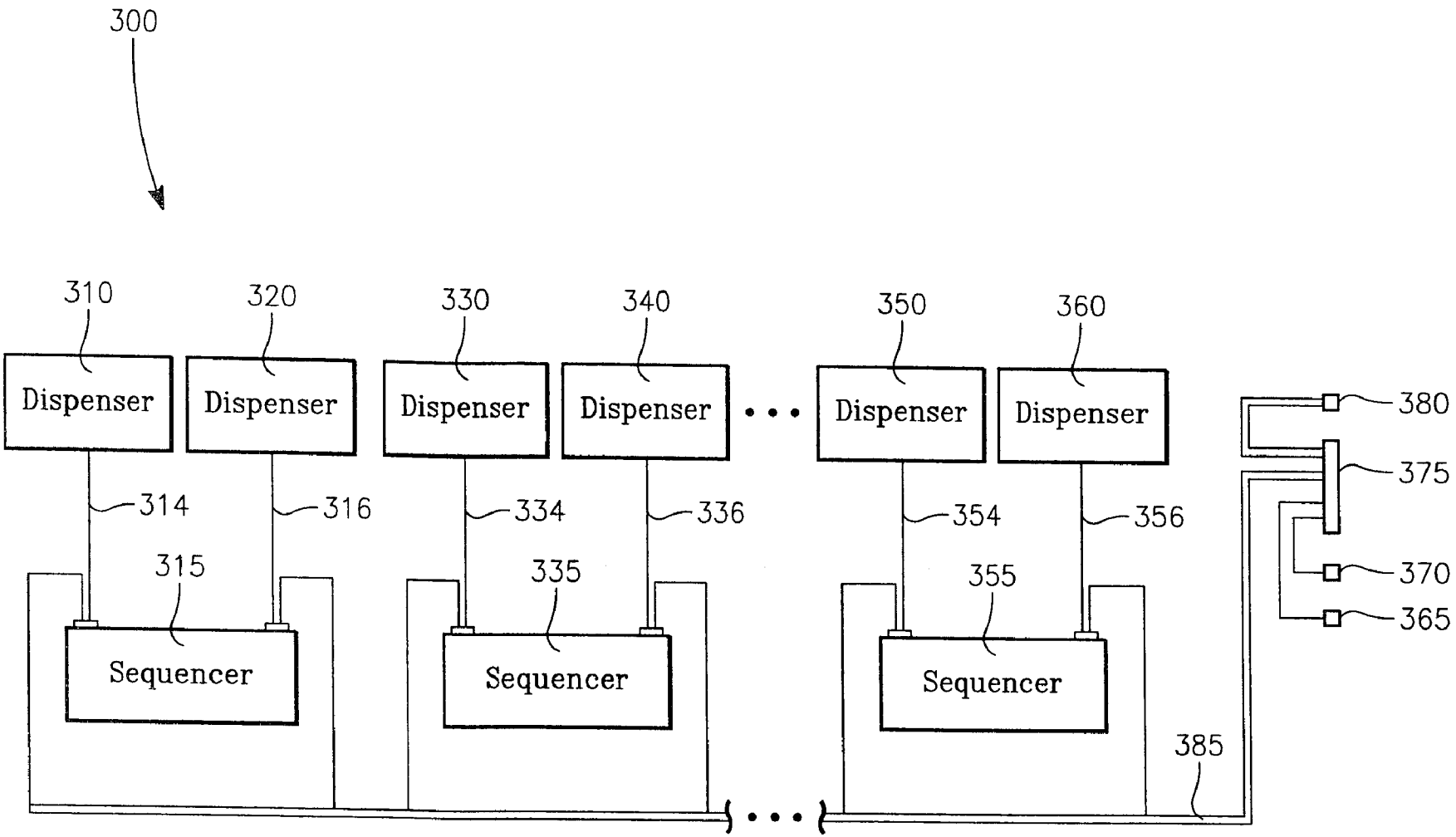
FIG. 3 is an electrical connection diagram depicting the preferred embodiment's countermeasure system.

FIG. 3 is an ALE-47 electrical connection diagram 300 depicting the connections for the preferred embodiment. For the sake of clarity, only three of the four sequencer assemblies are shown and only six of the eight dispenser assemblies are shown. A terminal block 375 is mounted to the rear bulkhead (FIG. 2 item 265) and is the main interface between the host aircraft and the pod. The terminal block 375 accepts through an umbilical connection 380 aircraft power and control signals. The pod must accommodate 115 volt, three phase power at a frequency of 400 Hz (5 amperes per phase) as well as positive 28 volts direct current. The aircraft power is routed to a power supply (FIG. 2 item 210) which supplies power to the ALE-47 components. Also connected to the terminal block are safety signals.

The dispensing assemblies (items 310, 320, 330, 340, 350 and 360) are prohibited from premature activation by a number of safety interlocks within the pod that override control by the pod's microcomputer. The first safety interlock is an arm and safety relay 370 signal that is used to energize a relay that close the normally open safety switch contacts. The second safety interlock is a hardware safety switch 365 that is in opens the path of the sequencer control signal present in wiring harness 385. In another embodiment the hardware safety switch 365 is replaced by a safety pin (not shown).

The terminal block 375 is connected to wiring harness 385 which contains the control signals to operate the sequencers (315, 335 and 355). Sequencer 315 is connected to dispenser 310 by wiring harness 314 and is also connected to dispenser 320 by wiring harness 316. Sequencer 335 is connected to dispenser 330 by wiring harness 334 and is also connected to dispenser 340 by wiring harness 336. Sequencer 355 is connected to dispenser 350 by wiring harness 354 and is also connected to dispenser 360 by wiring harness 356. In order to have adequate wiring harness access for connection and maintenance in the sequencer compartment (FIG. 4 item 420) it is necessary to stagger the placement of the sequencers (315, 335 and 355).

Referring to FIG. 2, the preferred embodiment orientation of the common services pod 201 when mounted to an aircraft is critical and is completely dependent upon proper positioning of the lugs (240 and 250) and lug adapters (241 and 251). The proper positioning of the lugs (240 and 250) and lug adapters (241 and 251) is perpendicular to a plane that is parallel to the dispenser assembly 280 opening. This will assure that that the flares leave the dispenser assemblies at an angle to clear the aircraft safely and to travel in the general direction of the attacking missile.

In another embodiment of the invention the proper positioning of the lugs (240 and 250) and lug adapters (241 and 251) is offset by 30 degrees relative to the plane that is parallel to the dispenser assembly 280 opening. This will assure that that the flares leave the dispenser assemblies at an angle to clear the aircraft safely and to travel in the general direction of the attacking missile.

The preferred embodiment of the common services pod is loaded with only one type of flare per mission. This limitation is a characteristic of the dispensing system and not of the common services pod. A fully loaded common services pod 201 has a center of mass and an overall weight for three flare types in accordance with the physical properties load out in Table 1. A three dimensional Cartesian coordinate system is used to identify the center of mass coordinates relative to the geometric center of the common services pod. A y axis extends axially through the nose cone 205 in the positive y direction and extends axially through the tail section 275 in the negative y direction. The z axis is perpendicular to the y axis and has a positive z direction that extends through the main body tube 220 in the direction of the sway braces 245. The z axis has a negative direction that extends through the main body tube 220 in the direction of the dispenser assemblies 280. The x axis is perpendicular to the y axis and extends through the side walls of the main body tube 220. The positive x axis is towards the viewer when viewing FIG. 2.

TABLE 1

| Flare Type | Flare Weight in lbs. | Number of Flares | Loaded Pod Weight in lbs. | Center of Mass in inches X direction | Center of Mass in inches y direction | Center of Mass in inches z direction |
|---|---|---|---|---|---|---|
| MJU-10 | 2.5 | 48 | 433 | −0.014 | 52.070 | 0.158 |
| M206 | 0.81 | 240 | 515 | −0.003 | 52.009 | −0.277 |
| MJU-7/13 | 1.9 | 120 | 546 | −.0029 | 51.980 | −0.409 |

The common services pod is unique in that the pod is readily adaptable to accepting new countermeasure dispensing systems by virtue of having a series of reconfigurable internal compartments. The common services pod is also unique in that the pod is readily adaptable to being mounted onto a new type of aircraft simply by incorporating a new mounting lug.

What is claimed is:

1. A method of rapidly dispensing countermeasures from a pod mounted on an aircraft comprising:

providing a pod, said pod having a forward bulkhead and a rear bulkhead; said pod having a plurality of longerons where a first end of each of said plurality of longerons is connected to an inner end of said forward bulkhead and a second end of each of said plurality of longerons is connected to an inner end of said rear bulkhead; said pod having a nose cone affixed to an outer end of said forward bulkhead; said pod having a tail section affixed to an outer end of said rear bulkhead; said pod having a power supply affixed to said outer end of said forward bulkhead; said pod having a microcomputer affixed to said outer end of said rear bulkhead; said pod having a strongback where a first end of said strongback is connected to the inner end of said forward bulkhead and a second end of said strongback is connected to the inner end of said rear bulkhead; said pod having a plurality of lug adapters affixed to said strongback and a plurality of lugs affixed to said lug adapters; said pod having a plurality of sway braces affixed to said strongback; said pod having an aluminum main body skin forming a partial tube which is wrapped around and connected to said plurality of longerons, said strongback, said forward bulkhead and said rear bulkhead;

providing a pair of mounting racks where a first end of said pair of mounting racks is connected to the inner end of said forward bulkhead and a second end of said pair of mounting racks is connected to the inner end of said rear bulkhead, said main body skin having a first edge connected to one of said mounting racks and a second edge connected to the second of said mounting racks;

providing a plurality of side by side open compartments running the length of said main body skin between said forward bulkhead and said rear bulkhead and formed between said pair of mounting racks;

providing an electrical wiring harness having a first end connected to a terminal block, having a second end connected to said power supply, a third end connected to said microcomputer and a fourth end connected to an aircraft umbilical mating connector, said electrical harness providing a plurality of connections to said side by side open compartments;

mounting said pod to said aircraft;

preventing a swaying of said pod when mounted to said aircraft;

mounting a plurality of components of a countermeasure dispenser system within said pod;

separating said plurality of components of said countermeasure dispenser system within said pod; and connecting electrically a terminal block to a power supply, to said plurality of components of said countermeasure dispenser system and to an aircraft umbilical mating connector.

2. The method of claim 1 wherein said terminal block accepts input from a plurality of safety interlocks.

3. The method of claim 1 further comprising providing a plurality of countermeasure devices that vary in type and vary in quantity, said plurality of countermeasure devices including infrared flares.

4. The method of claim 1 further comprising providing a plurality of countermeasure devices that vary in type and vary in quantity said plurality of countermeasure devices including metallic chaff.

5. The method of claim 1 wherein said rapidly dispensing countermeasures is a rate of up to two hundred forty of said countermeasures in ten minutes.

6. A method of configuring a pod to rapidly dispense a plurality of defensive countermeasure devices from an aircraft while said aircraft performs a mission wherein said mission includes a theater of operation, an ingress maneuver, deploys a cargo and subsequently performs an egress maneuver, said method comprising:

determining a first time corresponding to executing said ingress maneuver;

determining a second time corresponding to a time to deploy said cargo;

determining a third time corresponding to executing said egress maneuver;

selecting a type of said defensive countermeasure to accomplish said mission based upon said first time, said second time, said third time and said theater of operation;

selecting a quantity of said defensive countermeasure to accomplish said mission based upon said first time, said second time, said third time and said theater of operation;

providing a pod; said pod having a forward bulkhead and a rear bulkhead; said pod having a plurality of longerons where a first end of each of said plurality of longerons is connected to an inner end of said forward bulkhead and a second end of each of said plurality of longerons is connected to an inner end of said rear bulkhead; said pod having a nose cone affixed to an outer end of said forward bulkhead; said pod having a tail section affixed to an outer end of said rear bulkhead; said pod having a power supply affixed to said outer end of said forward bulkhead; said pod having a microcomputer affixed to said outer end of said rear bulkhead; said pod having a strongback where a first end of said strongback is connected to the inner end of said forward bulkhead and a second end of said strongback is connected to the inner end of said rear bulkhead; said pod having a plurality of lug adapters affixed to said strongback and a plurality of lugs affixed to said lug adapters; said pod having a plurality of sway braces affixed to said strongback; said pod having an aluminum main body skin forming a partial tube which is wrapped around and connected to said plurality of longerons, said strongback, said forward bulkhead and said rear bulkhead;

providing a pair of mounting racks where a first end of said pair of mounting racks is connected to the inner end of said forward bulkhead and a second end of said pair of mounting racks is connected to the inner end of said rear bulkhead, said main body skin having a first edge connected to one of said mounting racks and a second edge connected to the second of said mounting racks;

providing a plurality of side by side open compartments running the length of said main body skin between said forward bulkhead and said rear bulkhead and formed between said pair of mounting racks;

providing an electrical wiring harness having a first end connected to a terminal block, having a second end connected to said power supply, a third end connected to said microcomputer and a fourth end connected to an aircraft umbilical mating connector said electrical harness providing a plurality of connections to said side by side open compartments;

configuring said pod with said defensive countermeasure to accomplish said mission based upon said a type of said defensive countermeasure and said quantity of said defensive countermeasure; and mounting said pod to said aircraft.

7. The method of claim 6 wherein configuring said pod further includes:

preventing a swaying of said pod when said pod is mounted to said aircraft;

mounting a plurality of components of a countermeasure dispenser system within said pod;

separating said plurality of components of said countermeasure dispenser system within said pod; and electrically connecting a terminal block to a series of connections wherein a first connection in said series is to a power supply, a second connection in said series is to said plurality of components of said countermeasure dispenser system and a third connection in said series is to an aircraft umbilical mating connector.

8. The method of claim 6 wherein to rapidly dispense said plurality of defensive countermeasure devices is a rate of up to two hundred forty of said defensive countermeasure devices in ten minutes.

* * * * *